US008188951B2

(12) United States Patent
Im

(10) Patent No.: US 8,188,951 B2
(45) Date of Patent: May 29, 2012

(54) CHIP ON GLASS TYPE DISPLAY DEVICE

(75) Inventor: Chul-Woo Im, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 753 days.

(21) Appl. No.: 11/639,229

(22) Filed: Dec. 15, 2006

(65) Prior Publication Data

US 2007/0279351 A1 Dec. 6, 2007

(30) Foreign Application Priority Data

May 30, 2006 (KR) ..... 10-2006-0048785

(51) Int. Cl.
*G09G 3/36* (2006.01)
*G09G 5/00* (2006.01)

(52) U.S. Cl. ..... 345/87; 345/204

(58) Field of Classification Search ..... 345/87–102, 345/204; 349/149–152
See application file for complete search history.

(56) References Cited

U.S. PATENT DOCUMENTS 5,654,733 A * 8/1997 Chimura et al. ..... 345/96
2005/0012706 A1 * 1/2005 Murade ..... 345/99

* cited by examiner

*Primary Examiner* — Stephen Sherman
(74) *Attorney, Agent, or Firm* — Morgan, Lewis & Bockius LLP

(57) ABSTRACT

A display device includes a display panel including a display region and first and second non-display regions disposed at a periphery of the display region, a first drive integrated circuit including a first signal input terminal, a second drive integrated circuit including a second signal input terminal, the first and second drive integrated circuits disposed in the first non-display region, a circuit board generating and outputting a driving signal and disposed in the second non-display region, a first signal line interconnecting the first signal input terminal and the second signal input terminal, and a second signal line extending from the circuit board and connected to the first signal line at a central position of the first signal line.

8 Claims, 6 Drawing Sheets

CHIP ON GLASS TYPE DISPLAY DEVICE

The present invention claims the benefit of Korean Patent Application No. 10-2006-048785 filed in Korea on May 30, 2006, which is hereby incorporated by reference in its entirety.

BACKGROUND OF THE INVENTION

1. Field of the Invention

Embodiments of the invention relates to a display device, and more particularly, to a flat panel display device. Although embodiments of the invention are suitable for a wide scope of applications, they are particularly suitable for obtaining a chip on glass ("COG") display device that transmits the same voltage level signal to drive integrated circuits ("ICs").

2. Discussion of the Related Art

Flat panel display ("FPD") devices having portability and low power consumption have been a subject of recent researches in the coming of the information age. Among the various types of FPD devices, liquid crystal display ("LCD") devices are widely used as monitors for notebook computers and desktop computers because of their high resolution, ability to display colors and superiority in displaying moving images.

In general, an LCD device includes two glass substrates and a liquid crystal layer between the two glass substrates. The LCD device uses the optical anisotropy and polarization properties of liquid crystal molecules to produce an image. Due to the optical anisotropy of the liquid crystal molecules, refraction of light incident onto the liquid crystal molecules changes with the alignment direction of the liquid crystal molecules. The liquid crystal molecules have long thin shapes that can be aligned along specific directions, and the alignment direction of the liquid crystal molecules can be controlled by applying an electric field. Accordingly, the alignment of the liquid crystal molecules changes in accordance with the direction of the applied electric field. Thus, by properly controlling the electric field applied to a group of liquid crystal molecules within respective pixel regions, a desired image can be produced by appropriately modulating transmittance of the incident light. For example, an active matrix type LCD device using a thin film transistor as a switching element has been widely used to display a dynamic image.

FIG. 1 is a schematic view showing a liquid crystal display device having an LCD panel and a driving circuit unit according to the related art, and FIG. 2 is a schematic plan view of the LCD panel shown in FIG. 1. In FIG. 1, an LCD device includes an LCD panel 2 and a driving circuit unit 26. The driving circuit unit 26 includes an interface 10, a timing controller 12, a source voltage generation unit 14, a reference voltage generation unit 16, a source driver 18 and a gate driver 20.

The interface 10 receives data signals, such as red (R), a green (G) and blue (B) data, and control signals, such as an input clock, a horizontal synchronizing signal, a vertical synchronizing signal, and a data enable signal, from a driving system, such as a personal computer. The interface 10 then provides the data and control signals to the timing controller 12. The timing controller 12 then supplies the data and control signals to drive the source and gate drivers 18 and 20, respectively. Generally, a low voltage differential signal ("LVDS") interface or a time to live ("TTL") interface is utilized to transmit the data and control signals from the driving system. Further, the interface 10 and the timing controller 12 may be formed on a single chip.

As shown in FIG. 2, the LCD panel 2 includes a plurality of gate lines GL1 . . . GLn, and a plurality of data lines DL1 . . . DLm on a first substrate (not shown). A plurality of pixel regions P are defined by the crossing of the gate and data lines GL1 . . . GLn and DL1 . . . DLm. A thin film transistor TFT is formed at each crossing of the gate and data lines GL1-GLn and DL1 . . . DLm. In addition, a pixel electrode (not shown) is formed electrically connected to the thin film transistor TFT. Although not shown, a second substrate faces the first substrate and has a color filter and a common electrode formed thereon. Further, a liquid crystal layer may be interposed between the first and second substrates. The liquid crystal layer is driven by a vertical electric field between the pixel electrode and the common electrode, thereby displaying an image.

The timing controller 12 generates a control signal for driving the gate driver 20 and the source driver 18 using the control signal inputted through the interface 10. The gate driver 20 includes a plurality of gate driver ICs (not shown), and the source driver 18 includes a plurality of source driver ICs (not shown). Further, the inputted data through the interface 10 is transmitted to the source driver 18.

The reference voltage generation unit 16 generates a reference voltage of a digital to analog converter ("DAC") utilized in the source driver 18. The reference voltage is determined by a producer with respect to a transmittance-voltage (T-V) property of the LCD panel 2. The source driver 18 selects the reference voltage of the inputted data by responding to the inputted control signals from the timing controller 12, and a rotation angle of the liquid crystal molecule is controlled by providing the selected reference voltage to the LCD panel 2.

The gate driver 20 performs an ON/OFF control of the thin film transistors TFT arranged on the LCD panel 2 by responding to the control signals inputted from the timing controller 12. In particular, by sequentially enabling the gate lines GL1 . . . GLn by the required time for one horizontal synchronizing, the thin film transistors TFT are sequentially driven by one line to allow analog signals provided from the source driver 18 to be applied to the pixel electrodes to the thin film transistors TFT along the driven line.

Generally, the source driver 18 and the gate driver 20 include a plurality of chips. The source voltage generation unit 14 provides the LCD panel 2 with an operation source of respective elements. Further, the source voltage generation unit 14 generates and provides the LCD panel 2 with a voltage of a common electrode of the LCD panel 2. Also, although not shown, the LCD device further includes a backlight unit including a lamp to provide light onto the LCD panel 2.

Recently, a chip on glass (COG) type LCD device is suggested as a large size model that is in high demand by users. In the COG type LCD device, the drive IC chip is directly packaged on the LCD panel 2 to obtain a fine pitch, an ultra-thin and a light weight type model and the like. FIG. 3 is a schematic plan view showing a chip on glass ("COG") type LCD panel according to the related art, and FIG. 4 is an expanded view of a region "IV" of the COG type LCD panel shown in FIG. 3.

In FIG. 3, first to fourth source drive ICs S1 . . . S4 and first and second gate drive ICs G1 and G2 are packaged on an array substrate of an LCD panel 40 in a non-display region. The non-display region is along a periphery of an active area AA of the LCD panel 40. Each of the first to fourth source drive ICs S1 . . . S4 and each of the first and second gate drive ICs G1 and G2 receive signals from a circuit board 55. The circuit board includes a flexible printed circuit ("FPC") formed at an edge of the LCD panel 40.

However, although each of the first to fourth source drive ICs S1 . . . S4 spaced apart from the circuit board 55 with the same distance as each other directly receives the signals from the circuit board 55, the first and second gate drive ICs G1 and G2 spaced from the circuit board 55 at different distances. In particular, since the second gate drive IC G2, which is spaced further away from the first gate drive IC G1, the first gate drive IC G1 becomes a signal transmission means to the second gate drive IC G2 and the second gate drive IC G2 receives signals that are transmitted through the first gate drive IC G1.

As shown in FIG. 4, each of the first and second gate drive ICs G1 and G2 has a gate high signal terminal VGH and a gate low signal terminal VGL. The gate high signal terminal VGH and the gate low signal terminal VGL of the first gate drive IC G1 respectively face the gate high signal terminal VGH and the gate low signal terminal VGL of the second gate drive IC G2. A high signal line 60*a* is disposed between the gate high signal terminals VGH of the first and second drive ICs G1 and G2 to transmit the gate high signal $S_{VGH}$ from the first gate drive IC G1 to the second gate drive IC G2. Similarly, a low signal line 60*b* is disposed between the gate low signal terminals VGL of the first and second drive ICs G1 and G2 to transmit the gate low signal $S_{VGL}$ from the first gate drive IC G1 to the second gate drive IC G2. As a result, the gate high signal $S_{VGH}$ and the gate low signal $S_{VGL}$ transmitted to the second gate drive IC G2 is substantially not equal to the gate high signal $S_{VGH}$ and the gate low signal $S_{VGL}$ transmitted from the circuit board 55 due to the declination of the input signals between the first and second drive ICs G1 and G2.

Accordingly, when the first gate drive IC G1 is utilized as a signal transmission means for the second gate drive IC G2, there is a problem that the voltage level of the signal applied to the first gate drive IC G1 and the voltage level of the signal applied to the second gate drive IC G2 are different from each other. In other words, the voltage of the gate high signal $S_{VGH}$ and the gate low signal $S_{VGL}$ received by the first gate drive IC G1, which are directly inputted from the circuit board 55, are different from the voltage of the gate high signal $S_{VGH}$ and the gate low signal $S_{VGL}$ received by the second drive IC G2. In addition, signal attenuation occurs due to the transmission through the first gate drive IC G1 and due to the resistance of a signal line 60 including the high signal line 60*a* and the low signal line 60*b*.

The signal attenuation of the signal line 60 leads respective gate drive ICs G1 and G2 to transmit the different voltage levels to the gate lines. As a result, a screen division phenomenon occurs where a display image includes a gate block dim due to a brightness difference between a portion of the display region controlled by the first gate drive IC G1 and a portion of the display region controlled by the second gate drive IC G2.

SUMMARY OF THE INVENTION

Accordingly, embodiments of the invention is directed to a COG type display device that substantially obviates one or more of the problems due to limitations and disadvantages of the related art.

An object of embodiments of the invention is to provide a COG type display device that transmits the same voltage level to respective drive ICs.

Another object of embodiments of the invention is to provide a COG type display device that obtains a high quality by solving brightness difference due to signal attenuation by a signal transmission means.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a display device includes a display panel including a display region and first and second non-display regions disposed at a periphery of the display region, a first drive integrated circuit including a first signal input terminal, a second drive integrated circuit including a second signal input terminal, the first and second drive integrated circuits disposed in the first non-display region, a circuit board generating and outputting a driving signal and disposed in the second non-display region, a first signal line interconnecting the first signal input terminal and the second signal input terminal, and a second signal line extending from the circuit board and connected to the first signal line at a central position of the first signal line.

In another aspect, a display device includes a display panel including a first non-display region along a first edge of the display panel, and a second non-display region along a second edge of the display panel, a first drive integrated circuit including a first signal input terminal, a second drive integrated circuit including a second signal input terminal, the first and second drive integrated circuits disposed in the first non-display region, a circuit board generating and outputting a driving signal and disposed along the second edge, a first signal line extending from the circuit board and connecting to the first signal input terminal and the second signal input terminal, and a second signal line extending from the circuit board and connecting to the first signal input terminal and the second signal input terminal, the length of the first signal line substantially the same as the length of the second signal line.

In another aspect, a method of driving a display device includes generating and outputting a driving signal and disposed in a first non-display region of the display device; transmitting the driving signal to a first drive integrated circuit through a first signal line; and transmitting the drive signal to a second drive integrated circuit through a second signal line, wherein the first and second drive integrated circuits are in a serial arrangement in a second non-display region of the display device and wherein the first and second signal lines are in a parallel arrangement in the second non-display region It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
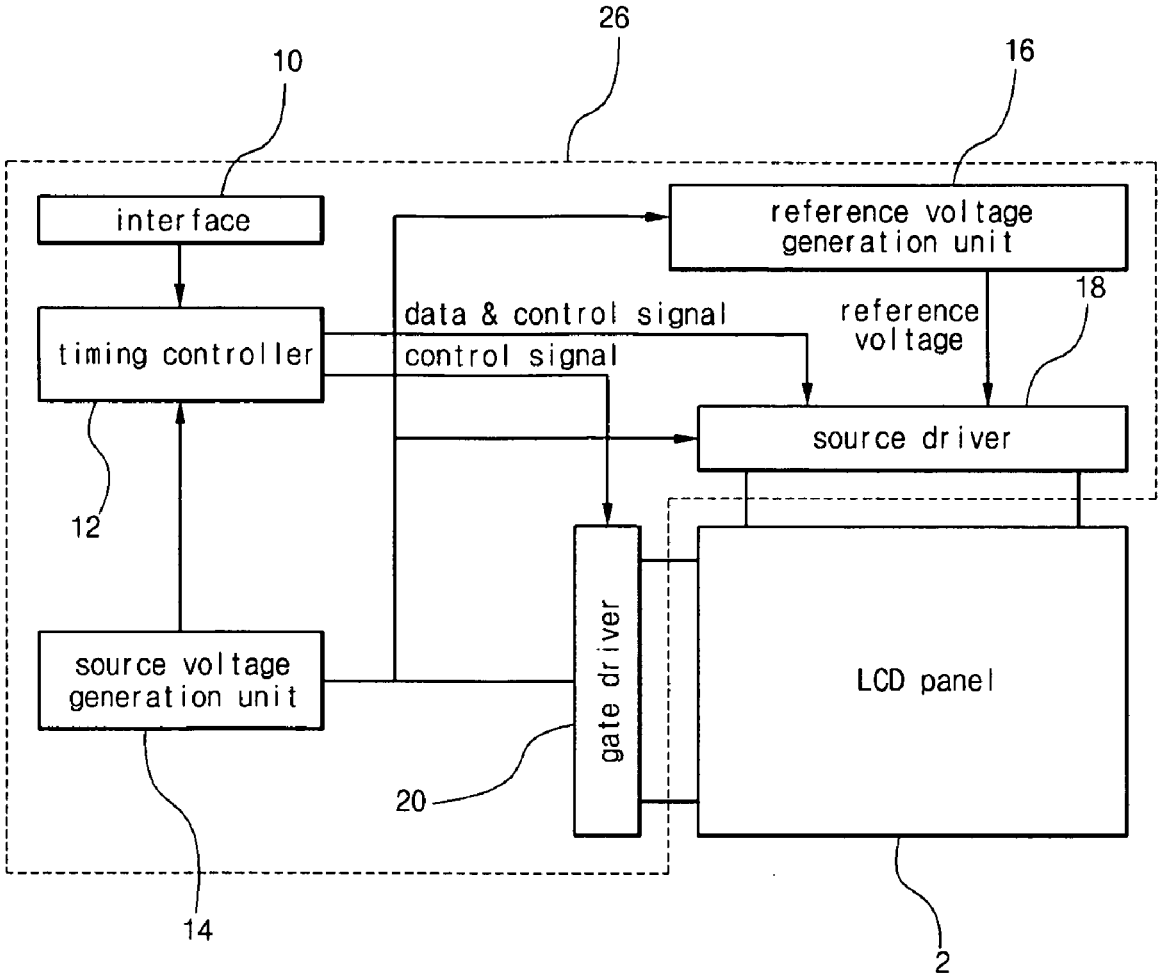
(related art) FIG. 1
FIG. 1 is a schematic view showing a liquid crystal display device having an LCD panel and a driving circuit unit according to the related art.
Figure 2:
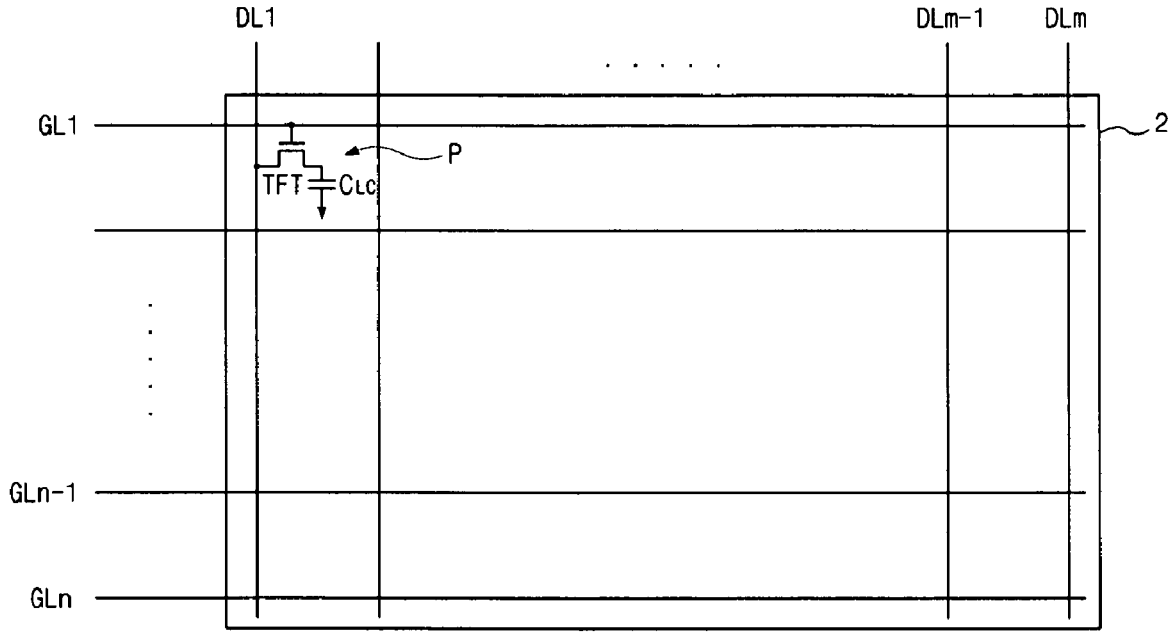
(related art) FIG. 2
FIG. 2 is a schematic plan view of the LCD panel shown in FIG. 1.
Figure 3:
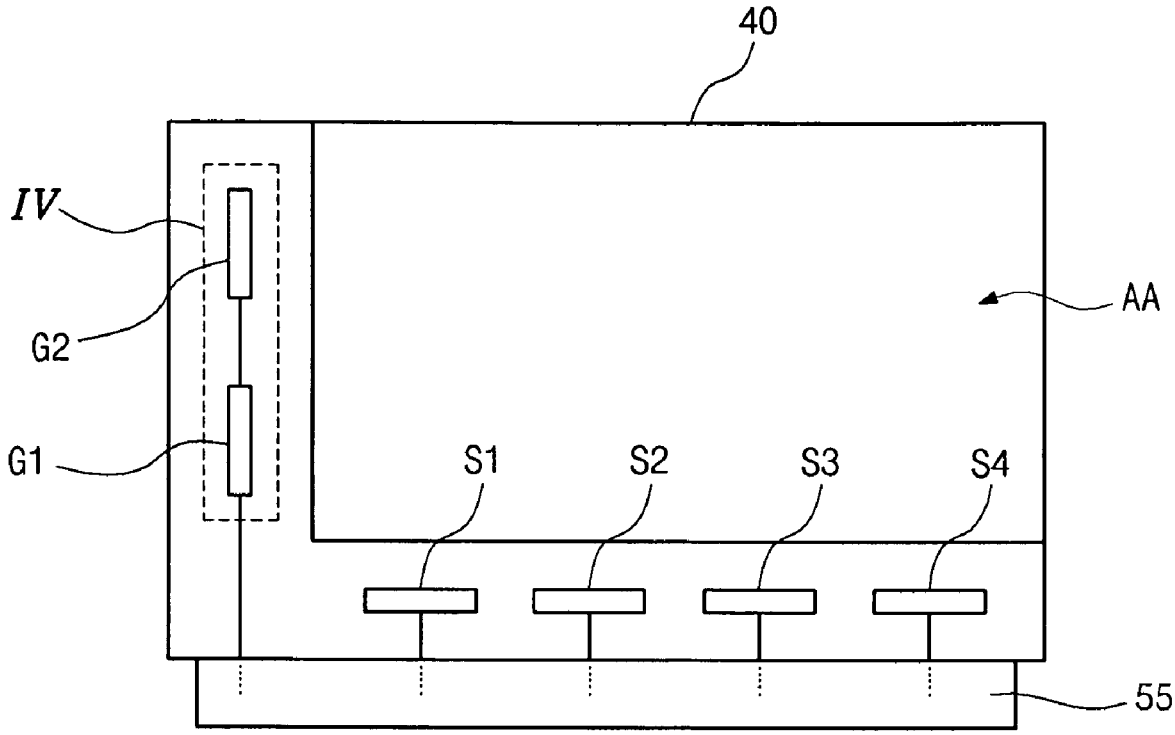
(related art) FIG. 3
FIG. 3 is a schematic plan view showing a chip on glass ("COG") type LCD panel according to the related art.
Figure 4:
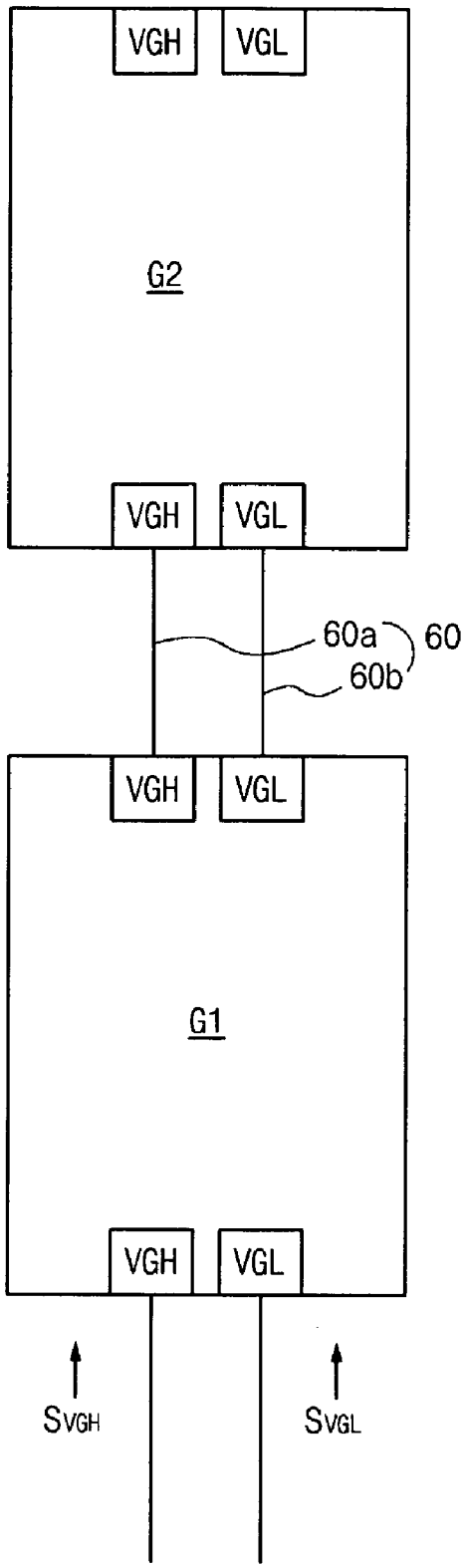
(related art) FIG. 4
FIG. 4 is an expanded view of a region "IV" of the COG type LCD panel shown in FIG. 3.
Figure 5:
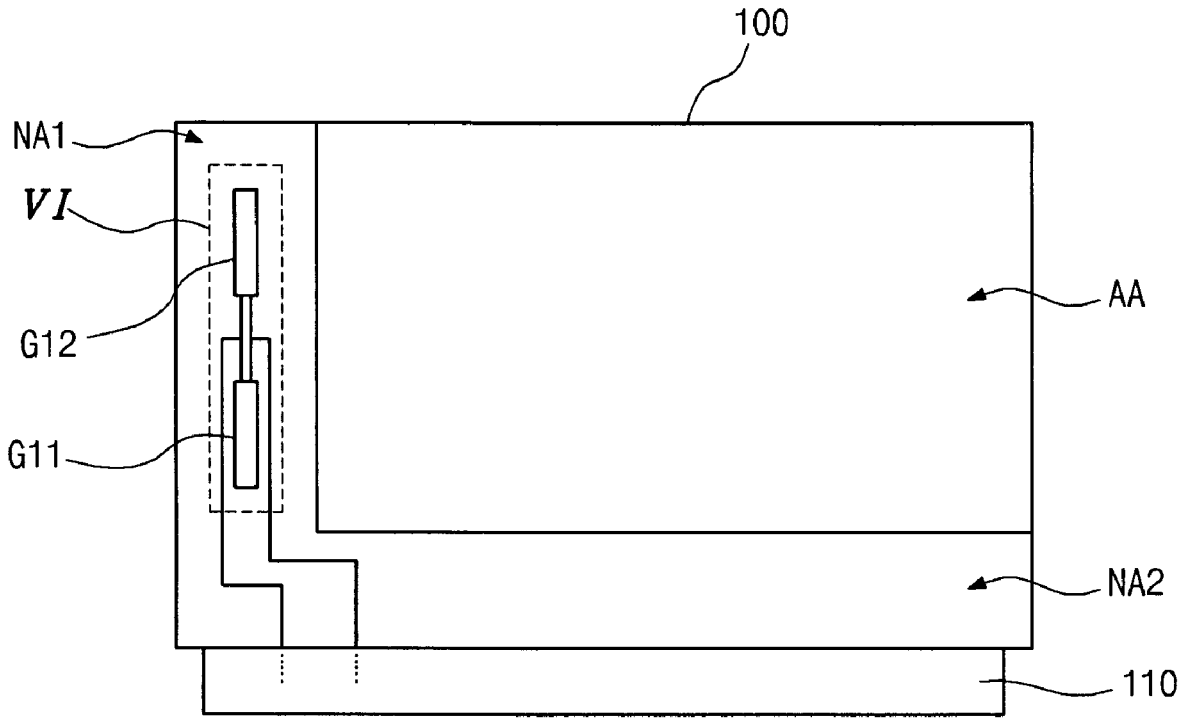
FIG. 5 is a schematic plan view showing a COG type display device according to an embodiment of the invention.
Figure 6:
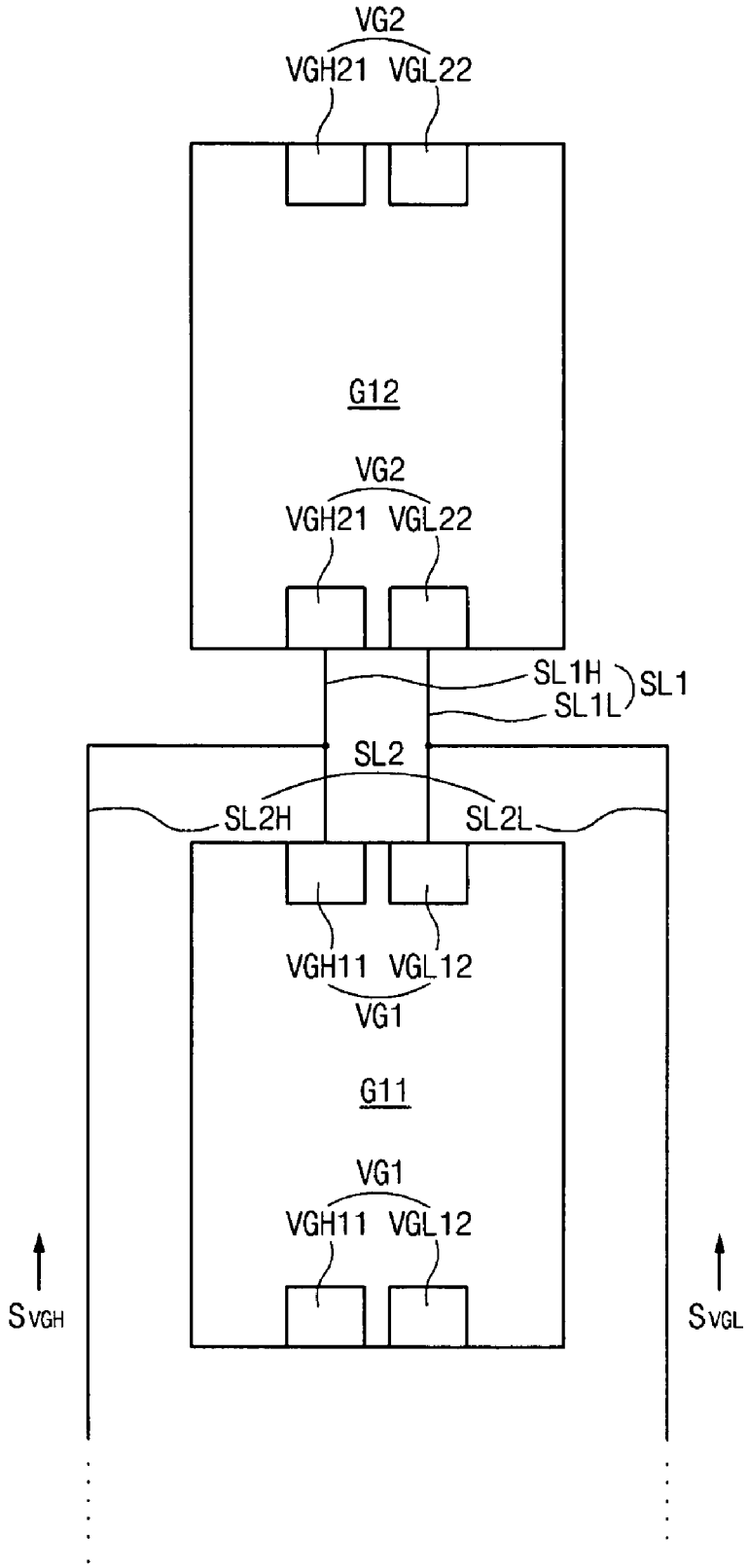
FIG. 6 is an expanded view of a region "VI" of the COG type LCD panel shown in FIG. 5.

FIG. 5 is a schematic plan view showing a COG type display device according to an embodiment of the invention, and FIG. 6 is an expanded view of a region "VI" of FIG. 5. In FIGS. 5 and 6, a first gate drive IC G11 and a second gate drive IC G12 are formed in a display device panel 100. The display device panel 100 may include an LCD device or an organic electroluminescent display device. A circuit board 110 is connected to an edge of the display device panel 100.

The display device panel 100 includes a display region AA and first and second non-display regions NA1 and NA2 along a periphery of the display region AA. The second non-display region NA2 is adjacent to the first non-display region NA1. The second non-display region NA2 is along the same edge of the display device panel 100 where the circuit board 110 is attached thereto, while the first non-display region NA1 is not along the same edge of the display device panel 100 as the circuit board 110. For illustration purposes, a drive IC, which may be disposed in the second non-display region NA2, is omitted, and the first and second drive ICs G11 and G12 are illustrated as disposed in the first non-display region NA1.

The circuit board 110 generates and outputs a gate driving signal including a gate high signal $S_{VGH}$ and a gate low signal $S_{VGL}$. The circuit board 110 includes one of an FPC board or a printed circuit board ("PCB"). In particular, a length of a signal transmission line between the first gate drive IC G11 and the circuit board 110 is substantially equal to a length of a signal transmission line between the second gate drive IC G12 and the circuit board 110.

As shown in FIG. 6, each of the first and second gate drive ICs G11 and G12 has two sets of gate signal terminals VG1 and VG2, respectively. Each set of the gate signal terminals VG1 and VG2 includes a first gate high signal terminal VGH11/VGH21 and a first gate low terminal VGL12/VGL22. The first gate drive IC G11 has one set of gate signal terminals VG1 in a bottom region and anther set of gate signal terminals VG1 in a top region. Similarly, the second gate drive IC G12 has one set of gate signal terminals VG2 in a bottom region and another set of gate signal terminals VG2 in a top region. The first gate signal terminal VG1 in the top region of the first gate drive IC G11 faces to the second gate signal terminal VG2 in the bottom region of the second gate drive IC G12. Specifically, the first gate high signal terminal VGH1 and the first gate low terminal VGL1 respectively face to the second gate high signal terminal VGH2 and the second gate low terminal VGL2.

In addition, a first signal line SL1 is disposed between the first gate signal terminal VG1 in the top region of the first gate drive IC G11 and the second gate signal terminal VG2 in the bottom region of the second gate drive IC G12. The first signal line SL1 connects the first gate signal terminal VG1 and the second gate signal terminal VG2. Specifically, the first signal line SL1 includes a first high signal line SL1H connecting the first gate high signal terminal VGH11 and the second gate high terminal VGH21, and a first low signal line SL1L connecting the first gate low signal terminal VGL11 and the second gate low terminal VGL22.

Further, a second signal line SL2 extending from the circuit board 110 is connected to the first signal line SL1. The second signal line SL2 may be connected to the first signal line SL1 at a central position of the first signal line SL1 along a lengthwise direction of the first signal line SL1 to simultaneously transmit a signal having the same voltage level to the first and second gate drive ICs G11 and G12.

Specifically, the second signal line SL2 includes a second high signal line SL2H connected to the first high signal line SL1H, and a second low signal line SL2L connected to the first low signal line SL1L. When the first and second signal lines SL1 and SL2 are formed as described above, the gate high signal $S_{VGH}$ and the gate low signal $S_{VGL}$ outputting from the circuit board 110 (of FIG. 5) are simultaneously inputted into the first gate drive IC G11 and the second gate drive IC G12. As a result, the gate high signal $S_{VGH}$ and the gate low signal $S_{VGL}$ are supplied to the first and second gate drive ICs G11 and G12 at substantially the same time. Thus, the same voltage level of the gate high signal $S_{VGH}$ and the gate low signal $S_{VGL}$ are supplied to the first and second gate drive ICs G11 and G12, since the amounts of attenuation in the respective signals supplied to the first and second gate drive ICs G11 and G12 are the same.

Therefore, an operation property of the respective first and second drive ICs G11 and G12 driven by the gate high signal $S_{VGH}$ and the gate low signal $S_{VGL}$ are equal to each other. In addition, because the voltage levels of the gate driving signals inputted the first and second drive ICs G11 and G12 are equal to each other, the brightness of a portion of the display region AA controlled by the first gate drive IC G11 and the brightness of a portion of the display region AA controlled by the second gate drive IC G12 are the same, and no brightness difference occurs in the display region AA.

The display device according to an embodiment of the invention is a COG type display device that minimizes defects caused by signal voltage attenuation due to a signal transmission means. Therefore, respective gate drive ICs are driven by the same voltage level and have the same driving property. Hence, a screen division phenomenon can be avoided, because the display region AA wholly has a uniform brightness.

Moreover, the COG type LCD device according to an embodiment of the invention has a line structure that removes declination of input signals between gate drive ICs. In the COG type LCD device according to an embodiment of the invention, the signals are transmitted by forming the signal line so that the signal attenuation declination is the same as each other to the respective gate drive ICs and is not a cascade type that same signals are transmitted through the adjacent gate drive ICs.

It will be apparent to those skilled in the art that various modifications and variations can be made in the COG type display device of embodiments of the invention without departing from the spirit or scope of the invention. Thus, it is intended that embodiments of the invention cover the modifications and variations of this invention provided they come within the scope of the appended claims and their equivalents.

What is claimed is:

1. A display device, comprising:

a display panel including a display region and first and second non-display regions disposed at a periphery of the display region;

a first drive integrated circuit including a first signal input terminal;

a second drive integrated circuit including a second signal input terminal, the first and second drive integrated circuits disposed in the first non-display region;

a circuit board generating and outputting a driving signal and disposed in the second non-display region;

a first high signal line and a first low signal line interconnecting the first signal input terminal and the second signal input terminal; and a second high signal line and a second low signal line respectively extending from the circuit board, the second high signal line connected to the first high signal line at a central position of the first high signal line, and the second low signal line connected to the first low signal line at a central position of the first low signal line, wherein each of the first high signal line and the first low signal line is positioned between the second high signal line and the second low signal line.

2. The display device according to claim 1, wherein the driving signal includes a high signal and a low signal.

3. The display device according to claim 2, wherein the first signal input terminal includes a first high signal input terminal and a first low signal input terminal, and the second signal input terminal includes a second high signal input terminal and a second low signal input terminal.

4. The display device according to claim 3, wherein the first signal line includes a first high signal line and a first low signal line, and wherein the first high signal line having a length between the first high signal input terminal and the second high signal input terminal substantially equal to a length of the first low signal line between the first low signal input terminal and the second low signal input terminal.

5. The display device according to claim 4, wherein the second high signal line having a length connected to the first high signal line substantially equal to a length of the second low signal line connected to the first low signal line.

6. The display device according to claim 1, further comprising at least a third drive integrated circuit disposed in the second non-display region.

7. A method of driving a display device, comprising:

generating and outputting a first driving signal and a second driving signal from a circuit board disposed in a first non-display region of the display device;

transmitting the first driving signal to a first drive integrated circuit and a second drive integrated circuit, respectively, through a first signal line and a second signal line; and transmitting the second driving signal to the first and drive integrated circuit and the second drive integrated circuit, respectively, through a third signal line and a fourth signal line, wherein the first and second drive integrated circuits are in a serial arrangement in a second non-display region of the display device and wherein the first and third signal lines interconnect the first and second drive integrated circuits, wherein the second and fourth signal lines are in a parallel arrangement in the second non-display region, and the first drive integrated circuit is positioned between the first and third signal lines, and wherein the first signal line is connected to the third signal line at a central position of the third signal line, and the second signal line is connected to the fourth signal line at a central position of the fourth signal line.

8. The method according to claim 7, wherein the first drive integrated circuit receives the driving signal at substantially the same time as the second drive integrated circuit receiving the driving signal.

* * * * *